United States Patent [19]

Clayton

[11] Patent Number: 4,860,478

[45] Date of Patent: Aug. 29, 1989

[54] CARTRIDGE HOLDER

[75] Inventor: Cameron Clayton, Yukon, Canada

[73] Assignee: Willard L. Phelps Consultants Ltd., Whitehorse, Canada

[21] Appl. No.: 92,187

[22] Filed: Sep. 2, 1987

[30] Foreign Application Priority Data

Sep. 9, 1986 [CA] Canada ..... 517793

[51] Int. Cl.[4] ..... F42B 39/02

[52] U.S. Cl. ..... 42/71.01; 224/239

[58] Field of Search ..... 206/3, 443; 42/71.01, 42/49.01; 224/203, 223, 235, 239, 245, 253, 0.5

[56] References Cited

U.S. PATENT DOCUMENTS

| | | | |
|---|---|---|---|
| 162,481 | 4/1875 | Lee | 224/203 X |
| 173,543 | 2/1876 | Howe | 206/3 UX |
| 1,405,508 | 2/1922 | Endres et al. | 206/3 X |
| 1,628,133 | 5/1927 | Ferst | 206/3 X |
| 2,587,921 | 3/1952 | Suite | 42/71.01 |
| 2,605,033 | 7/1952 | Terry | 42/71.01 X |
| 2,995,280 | 8/1961 | Thierry | 224/239 |
| 3,066,791 | 12/1962 | Bivens | 206/3 |
| 4,583,659 | 4/1986 | Carter | 224/239 X |

FOREIGN PATENT DOCUMENTS

| | | |
|---|---|---|
| 24487 | 7/1886 | Canada . |
| 101333 | 10/1906 | Canada . |
| 126888 | 6/1918 | Canada . |
| 424617 | 12/1944 | Canada . |
| 593027 | 2/1960 | Canada . |
| 941338 | 2/1974 | Canada . |

*Primary Examiner*—J. R. Scott

*Attorney, Agent, or Firm*—Arnold, White & Durkee

[57] ABSTRACT

Disclosed is a cartridge holder comprising a base including provision for attaching the holder to a stock of a firearm. The base includes at least one aperture for accommodating a cartridge, and includes a metal structure facilitating easy removal of the cartridge from the aperture, the cartridge having a shell portion and a head portion. A cover is associated with the base for covering at least a portion of the shell portion, and is moveable to permit selective removal of the cartridge.

3 Claims, 2 Drawing Sheets

CARTRIDGE HOLDER

FIELD OF THE INVENTION

The invention pertains to a cartridge holder for ammunition and more particularly to a cartridge holder for single action or shot firearms.

BACKGROUND OF THE INVENTION

The development of firearms has proceeded over many years from single action or shot devices to automatic devices having facilities for many rounds of ammunition.

Notwithstanding the advance in firearms and their construction, there remains many single action firearms, and sales of such devices are still significant for the recreational hunter. Even professional hunters in the North often have or prefer single action devices.

A common single action firearm is the 0.22 calibre rifle.

Although cartridge holders worn as a belt or shoulder harness are known and provide for an orderly array of ammunition to be selectively used in loading and firing the gun, it would be advantageous to have a simple device for holding ammunition on or associated with part of the gun itself. Such a device must be structurally sound yet simple in operation and nonobstructive to the user.

SUMMARY OF THE INVENTION

Accordingly, applicant's invention pertains to a cartridge holder adapted for fixed association with the stock of a gun or firearm and which provides means for holding a plurality of individual cartridges relatively securely and yet providing for easy access to the cartridges and easy removal from the holder.

More particularly the invention comprehends a cartridge holder comprising a base having means for attaching the holder to a stock of a firearm, the base having at least one aperture means for accommodating a cartridge and having means for facilitating easy removal of the cartridge from the aperture, the cartridge having a shell portion and a head portion. Cover means is associated with the base for covering at least a portion of the shell portion and it is moveable to permit selective removal of the cartridge.

A further feature of the invention comprehends the means for facilitating removal of the cartridge including a bevelled, V-shaped recess in a front of the base adjacent the top thereof to provide access to a rim of the shell portion.

A still further feature of the invention provides a cover which is pivotally connected to the base and associated therewith in such manner as to have frictional contact requiring manual relative movement.

The base preferably has recess means adjacent its top to accommodate the rim of the shell portion, the cover also having frictional contact with the end of the shell portion.

In addition, and in a preferred embodiment, means are provided at the end of the cover means opposite the pivotal connection to facilitate initiating pivoting movement of the cover relative the base.

DESCRIPTION OF THE EMBODIMENTS

Figure 1:
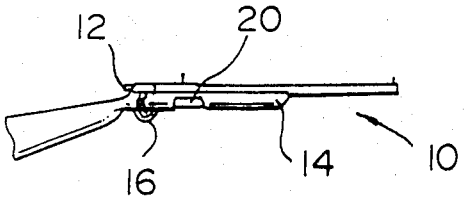
FIG. 1 is an illustration, somewhat schematically, of a rifle to which the inventive cartridge holder is associated.
Figure 2:
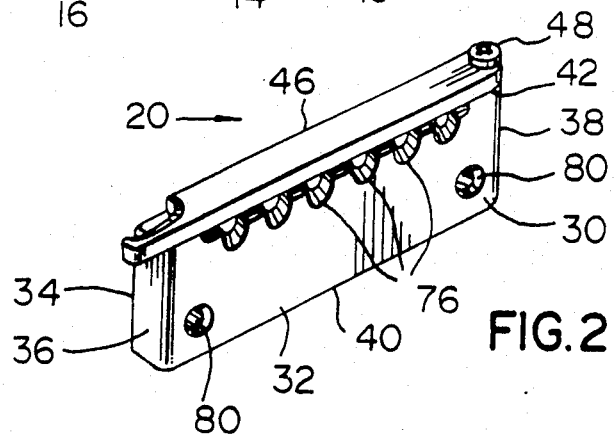
FIG. 2 is a front perspective view of the cartridge holder.
Figure 3:
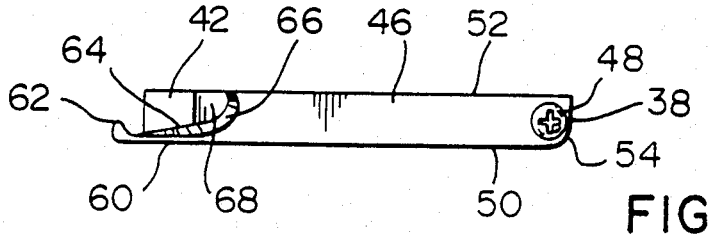
FIG. 3 is a top view with the cover closed.
Figure 4:
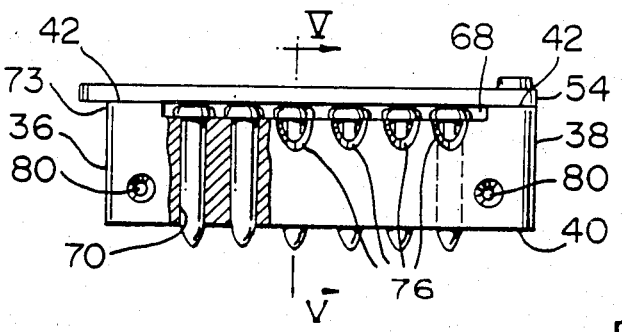
FIG. 4 is a front elevational view of the holder.
Figure 5:
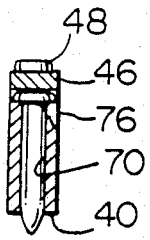
FIG. 5 is a sectional view along line 5—5 of FIG. 4.
Figure 6:
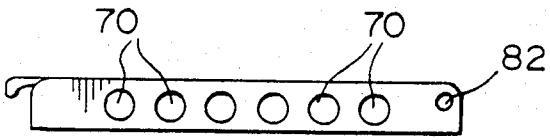
FIG. 6 is a bottom view of the holder.
Figure 7:
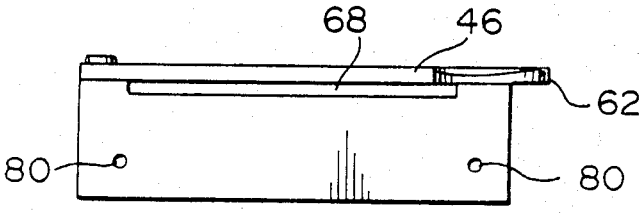
FIG. 7 is a back view of the holder (without ammunition).
Figure 8:
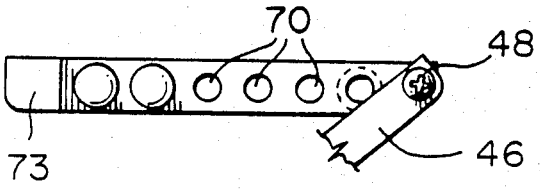
FIG. 8 is a top view with the cover (shown in part) open.

Now referring to FIG. 1, there is shown a single action rifle 10 such as a 0.22 calibre rifle with bolt action 12 and forward stock portion 14. Forward of trigger mechanism 16 on stock portion 14 is cartridge holder 20. Holder 20 is rearward of where hand placement on stock portion 14 would occur when the rifle is being fired.

Now referring to FIGS. 2–8, the holder 20 is shown in various views and comprises a generally rectangular base 30 having front 32, back 34, sides 36 and 38, bottom 40 and top surface 42. A generally rectangular top cover 46 is pivotally mounted on top surface 42 adjacent side 38 by screw 48. Top cover 46 has a generally rectangular shape complementary to base 30 in that the front 50, back 52 and right end 54 (as seen in the drawings) of top cover 46 are planar with the respective front 32, back 34 and right side 38 of base 30.

The left end 60 of cover 46 has a portion 62 which protrudes beyond the plane of side 36 and is shaped to provide a means for unitary pivoting of cover 46 relative to base 30. More particularly, this means includes protrusion part 62 which may be contacted by thumb or finger. Also provided is recessed portion 64 which is bevelled at 66 such as to provide comfortable access from the top by way of a thumb or finger. It will be appreciated that with portion 64, the left end of cover 46 need not protrude if thought desirable since access for initiating pivoting of cover 46 may be fully provided by the recess 64 and associated bevelled portion 66.

Top surface 42 of base 30 has a longitudinally oriented centrally located recess 68 with a plurality of through 70, six being shown in the drawings. Recess 68 is provided to accommodate the thickness of the rim on the shells with which the holder is to be associated. The depth of recess 68 is not only to accommodate the rim of the shells but is such that there is a slight frictional contact between the end of the shell and the undersurface of cover 46. Further, the height of portion 73 of surface 42 adjacent side 36 is such as to have a frictional relationship with the undersurface of cover 46 associated therewith. Portion 73 may also be slanted upwardly, rearwardly, slightly to enhance frictional contact with cover 46. Apertures 70 extend through base 30 and are of a diameter to provide a snug fit but with axial movement of cartridges therein.

It will be seen that the depth of base 30 is such that the tips of the cartridges extend slightly below bottom 40. This permits initiating movement of the cartridges upward through finger contact with the ends of the cartridges.

The front 32 of base 30 has adjacent each aperture 70, a bevelled "V" shaped recess 76 which permits the users thumb or finger (or nail) to come in contact with the inside of the rim of the shell and initiate or continue movement of the cartridge from its aperture.

Apertures 80 are provided for accommodating appropriate screws for attachment of holder 10 to the stock 14 of the rifle. Aperture 82 is simply the extension of the aperture to which screw 48 is associated and need not be included since screw 48 could be associated with a blind hole. However, its presence does not detract from the holder and indeed adds slightly in reducing its weight.

The number of apertures 70 is of course optional although six are shown and believed to be appropriate in most instances.

In use, the holder 10 is secured to the rifle stock forward of the bolt 12 and located where the hunter may, with his trigger hand, pivot cover 46 away from the stock. Then with a finger, pushing upwardly on the top of the cartridge and at the same time or subsequently, a thumb movement upwardly along front 32 adjacent recess 76, contacting the rim of the shell, the cartridge is removed. The cartridge is inserted into the bore and cover 46 closed.

The construction of the holder is such that comfortable and easy hand and finger movement enables a cartridge to be extracted from the holder. After the last cartridge is extracted, the holder may be replenished with cartridges.

It will be apparent that various modifications of this holder is possible within the scope of the invention. By way of example, holder 10 could have pressure adhesive means for securement to rifle stock 14. Further, the device can be adapted for either side of the rifle and indeed a second aperture, the mirror image of aperture 82 could be provided in base 12 so that a mirror image cover 46 could be appropriately pivotally secured to base 12 for use on the left side of the stock for left hand trigger users. It will even be appreciated that cover 46 could, if the underside of it was bevelled like recess 64, be reversed for left handed mounts.

Although a recess 76 has been shown for each cartridge aperture 70, it will be appreciated that a single recess extending from the first to the last of a row of apertures could be provided.

Device 10 is preferably of a light material such as aluminum but it will be appreciated that the device can be constructed of suitable plastic material, compatible with outdoor environmental use.

Accordingly applicant has disclosed a simple but novel cartridge holder for use in association with a single shot rifle type firearm, which holder provides ready and convenient access to additional ammunition to the user.

The embodiments of the invention in which an exclusive property or privilege is claimed are defined as follows:

1. A cartridge holder, comprising:

a base of substantially rigid material and of generally rectangular configuration and having an upper surface, a lower surface, a rear surface, a front surface, and opposed end surfaces;

said base having means by which the holder can be secured with its rear surface to the side of a stock of a firearm;

said upper surface including a longitudinally extending recess intermediate the end surfaces of said base said base including a row of generally vertical bores extending downwardly from said recess through said base;

said front surface including a plurality of upwardly opening notches, each said notch communicating with one of said bores adjacent said recess, whereby a portion of the underside of a rim of a cartridge in a bore is exposed and contactable by the fingers of a user of the firearm;

an elongated, substantially rigid cover pivotally secured to said base adjacent the juncture of the upper surface and an end surface which in a closed position covers said recess and the rims of cartridges in said bores and which is laterally pivotable outwardly of said base to an open position to expose said cartridges for use;

said cover means having a free end of reduced width relative to that of the rest of said cover means, thereby defining a finger engageable protrusion spaced from the plane of the rear surface and providing means for initiating pivotal movement of the cover from the closed to the open position.

2. The cartridge holder of claim 1, wherein said plurality of upperly opening notches in said front surface are generally V-shaped notches.

3. The cartridge holder of claim 1 wherein the pivotal securement of said cover includes frictional resistance requiring manual relative movement.

* * * * *